United States Patent [19]

Korich

[11] 4,141,445

[45] Feb. 27, 1979

[54] BLADE CARTRIDGE STORAGE CAP AND RAZOR HOLDER

[76] Inventor: George P. Korich, 8604 E. Old Spanish Trail, Tucson, Ariz. 85710

[21] Appl. No.: 788,815

[22] Filed: Apr. 19, 1977

Related U.S. Application Data

[63] Continuation-in-part of Ser. No. 653,967, Jan. 28, 1976, abandoned.

[51] Int. Cl.[2] ..... B65D 16/00

[52] U.S. Cl. ..... 206/228; 206/354; 220/85 R; 132/80 R; 211/13; 222/182; 221/131

[58] Field of Search ..... 222/130, 192, 182; 132/80 R; 206/354, 228; 221/96, 199; 215/100 R; 220/85 D, 85 R; 211/13

[56] References Cited

U.S. PATENT DOCUMENTS

| | | | |
|---|---|---|---|
| 3,272,323 | 9/1966 | Ewry | 215/100 R |
| 3,486,630 | 12/1969 | Ellman | 132/80 R |
| 3,732,591 | 5/1973 | Gach | 222/192 |

FOREIGN PATENT DOCUMENTS

| | | | |
|---|---|---|---|
| 1087491 | 2/1955 | France | 215/100 R |

*Primary Examiner*—Allen N. Knowles

*Attorney, Agent, or Firm*—Knechtel, Valentino, Demeur & Dallas

[57] ABSTRACT

There is disclosed a cap adapted for enclosing an aerosol can such as a shaving cream can, formed by a peripheral side wall and having a closed top and an open bottom end, the cap being substantially cylindrical in configuration, the peripheral side wall of the cap including an elongated slot extending along a line parallel to the tangential plane of the peripheral side wall and further including engagement lugs mounted on the peripheral side wall of the cap and positioned below the elongated slot, the engagement lugs cooperating with the elongated slot to facilitate the retention of a blade cartridge razor therein. In a preferred embodiment, the cap is further provided with a plurality of vertically oriented slots formed in the side wall, the slots having a closed bottom and an open top, access to which is had through a cut-away portion in the top of the cap, each of the vertically oriented slots being adapted to carry in storage configuration, a blade cartridge.

10 Claims, 8 Drawing Figures

FIG. 1
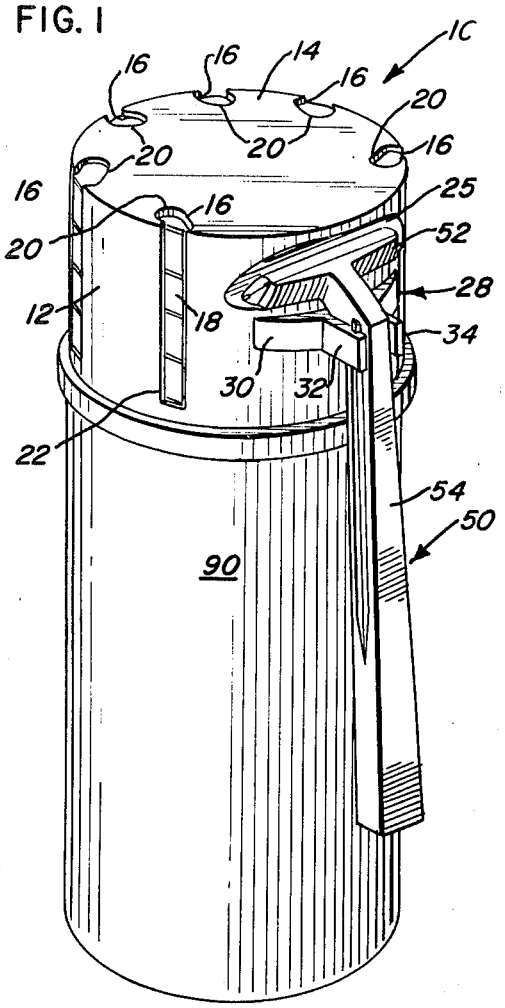
FIG. 4
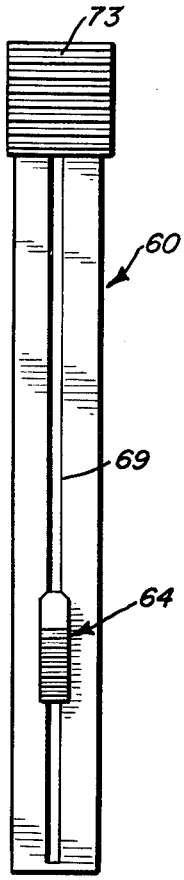
FIG. 5
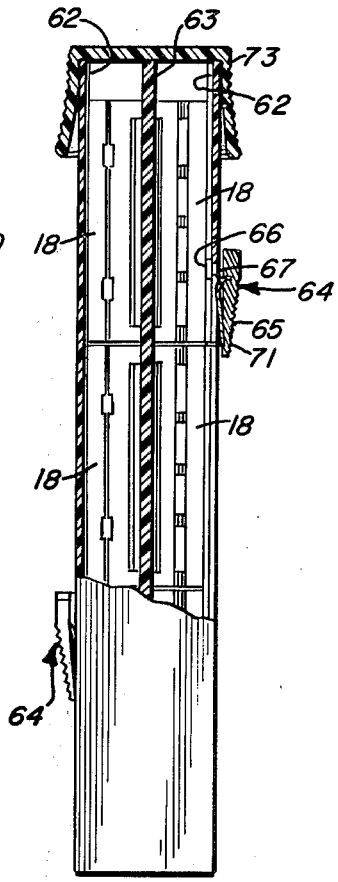
FIG. 2
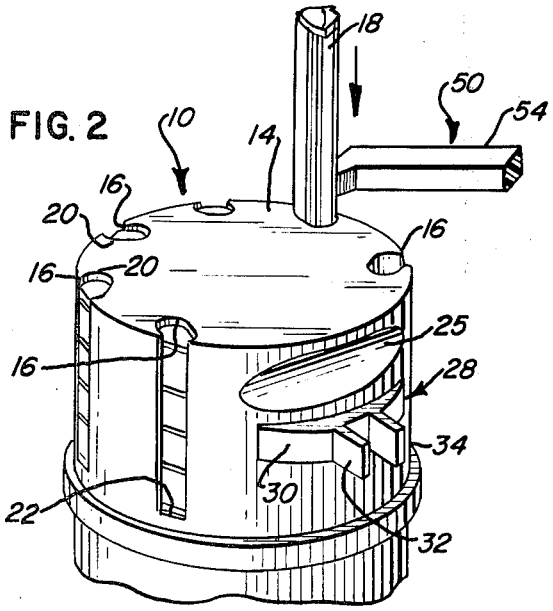
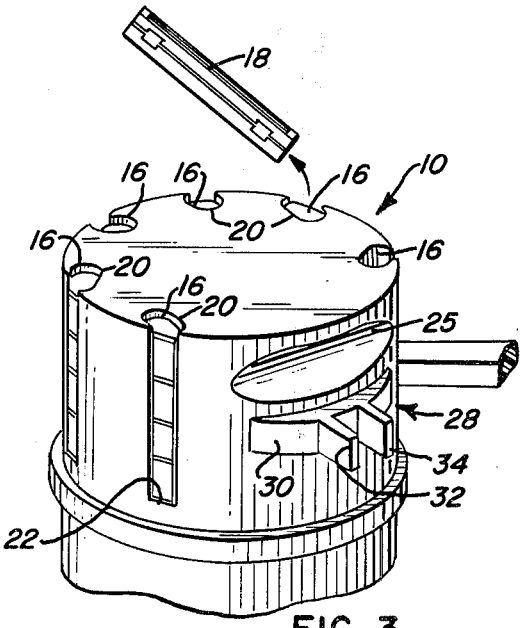
FIG. 3

BLADE CARTRIDGE STORAGE CAP AND RAZOR HOLDER

REFERENCE TO RELATED APPLICATIONS

This invention is a continuation-in-part application of Ser. No. 653,967 filed on Jan. 28, 1976 in the name of George P. Korich entitled BLADE CARTRIDGE DISPENSER, now abandoned.

BACKGROUND OF THE INVENTION

It is well known that a variety of closure caps are known in the art, generally any particular close cap being designed to fulfill a particular function. This is quite evident, especially in the medicinal art field wherein enclosure caps for various containers which are designed to contain a particular type of medicament are designed with a view toward single unit dosage characteristics or other such characteristics. In addition, the art field pertaining to caps and/or containers which are adapted and constructed to provide storage compartments for various auxillary implements are similarly well known. In general, such caps and/or containers are designed with a view toward minimizing the storage space necessary to store a variety of implements and hence, the main purpose is to provide a cap or container which can conveniently store such implements ideally in modular form.

Various prior art patents exist relating to a variety of such caps and/or containers which are provided with auxilliary storage chambers although none of such containers or caps have achieved any great degree of sommecial success. For example, U.S. Pat. No. 3,426,769 is directed to a container which is provided with a recess portion to accommodate a shaving razor implement as well as to provide a false bottom which is removably affixed to the container, the false bottom containing a supply of razor blades in storage configuration. It will be observed, however, that in order to provide the storage chamber for the razor as well as the bottom chamber for the razor blades, a relatively significant portion of the interior volume of the container is consumed such that the amount of space left to accommodate the shaving material is substantially reduced. Hence, such devices have not been particularly useful commercially since container sizes and the pricing of such containers is dependent upon a given fluid volume of the shaving material vended to the public.

Another form of a cap which is designed to coact with a container shown in U.S. Pat. No. 3,195,784 which is directed to a multi-tip dispensing device. The structure depicted in this patent is designed to provide a storage compartment for a plurality of dispensing tips which may be employed in connection with the dispensing nozzle of the pressurized dispensing can.

Similar attempts have been made with regard to providing some form of a storage arrangement for storing razor blades as well as razors in connection with aerosol shaving cream cans. As mentioned previously, U.S. Pat. No. 3,426,769 was a prior art attempt at providing such a device. In addition, U.S. Pat. No. 3,486,630 shows a shaving implement holder which is designed to be removably positionable atop any given shaving cream aerosol container and in effect, comprises a storage tray designed to store the blade razor, a supply of razor blades, and other accoutrements such as a styptic pencil. It will be observed that the device shown in U.S. Pat. NO. 3,486,630 is provided as a separate element and is designed to be carried atop the aerosol shaving cream bomb in the manner of a tray or a caddy. As such, the device extends laterally outwardly from the side confines of the container and hence, is cumbersome to store in any event. It would be appreciated that if a shaving cream can is provided with a caddy of the type shown in U.S. Pat. No. 3,486,630, and is stored in a typical medicine chest, a significant amount of space will be consumed, such that several articles could not be placed adjacent to the shaving cream can.

OBJECTS AND ADVANTAGES

It is therefore the principal object of this invention to provide an improved enclosure cap for use in connection with an aerosol can, wherein the cap is designed to function as a storage device for a blade cartridge razor, and in the preferred embodiment, to additionally provide storage facilities for a plurality of blade cartridges.

In connection with the foregoing object, it is yet a further object of this invention to provide a cap of the type described wherein the storage and positioning of a blade cartridge razor in a storage posture on the cap is effected with a minimum amount of wasted storage space while maximizing the ability to store articles adjacent to the shaving cream container.

A further object of this invention is to provide a cap suitable for use with an aerosol can, especially one adapted as a shaving cream container, wherein the cap is adapted for removable positioning atop the shaving cream can, the cap being formed by a peripheral sidewall and having a closed top and an open bottom, the cap including holding means formed integrally therewith for removably holding a blade cartridge razor therein, and the cap being constructed to carry the blade cartridge razor when positioned on top of the shaving cream can and further, when removing the shaving cream can.

In connection with the foregoing object, it is yet a further object of this invention to provide a cap of the type described which further includes additional holding means formed integrally therewith for removably holding at least one blade cartridge therein.

In connection with the foregoing objects, it is yet a further object of the invention to provide a cap of the type described wherein the cap is formed by a peripheral sidewall and having a closed top and an open bottom, the cap including a plurality of vertically oriented holding means formed therein, each of the holding means adapted to accommodate a blade cartridge therein, the peripheral sidewall further including an elongated slot extending along the line parallel to the tangential plane of the peripheral side wall, engagement means mounted on the peripheral sidewall of the cap and positioned below the elongated slot, the engagement means cooperating with the elongated slot to facilitate the retention of the blade cartridge razor therein such that the cap provides a plurality of storage slots for the storage of a plurality of blade cartridges, and in addition, provides a convenient retention means for retaining the blade cartridge razor in a storage posture directly on the cap.

In connection with the foregoing object, it is yet a further object of the invention to provide a cap of the type described wherein the vertically extending slot is formed in the configuration of the blade cartridge and has an overall interior dimension slightly in excess of the exterior dimension of the blade cartridge whereby the blade cartridge may be removably positioned within the confines of the vertically extending slot thereby to be removable therefrom by means of a snap action removal system.

In connection with all of the foregoing objects, it is yet a further object of the invention to provide a cap of the type described wherein the engagement means is formed by a pair of spaced apart lugs mounted on the peripheral sidewall and extending laterally outwardly therefrom, the pair of lugs being positioned below the elongated slot and in cooperative relation therewith such that the blade cartridge portion of the blade cartridge razor may be accommodated within the confines of the elongate slot and the handle portion of the blade cartridge razor may be removably positioned within the confines of the spaced apart lugs such that the entire blade cartridge razor is removably engageable therefrom.

Further features of the invention pertain to the particular arrangement of the elements and parts whereby the above-outlined and additional operating features thereof are attained.

The invention, both as to its organization and method of operation, together with further objects and advantages thereof, will best be understood by reference to the following specification, taken in connection with the accompanying drawings.

BRIEF DESCRIPTION OF DRAWINGS

With reference to the accompanying drawings, the following is shown:

FIG. 1 is a perspective view of a typical aerosol shaving cream can having a cap of the subject invention removably positioned thereon;

FIG. 2 is a perspective cut-away view, showing the manner in which the blade cartridges are retained within the vertically extending slots formed in the cap;

FIG. 3 is a perspective, partially cut-away view showing the entire removal of a typical blade cartridge from the vertically extending slot;

FIG. 4 is a side elevational view of a blade cartridge dispenser which operates to permit the convenient storage of a plurality of blade cartridges;

FIG. 5 is a side elevational view, partly in cross-section, showing the details of construction of the blade cartridge dispenser as described in connection with FIG. 4;

SUMMARY OF THE INVENTION

Figure 6:
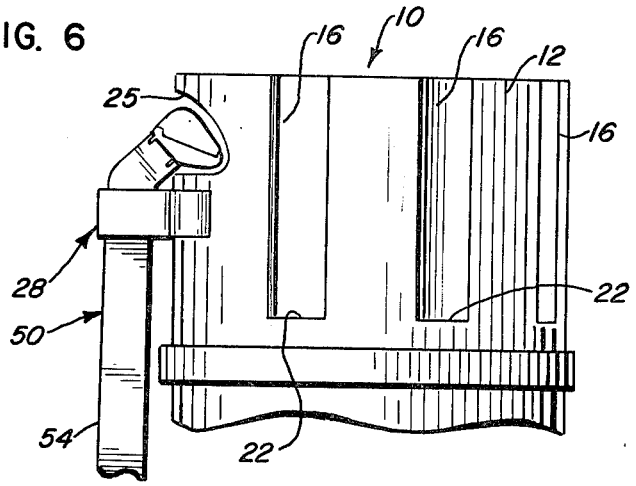
FIG. 6 is a side elevational view, partly cut-away, showing the manner in which the retention means and engagement means of the cap of the present invention function to retain a typical blade cartridge razor in position on the subject cap.

The present invention is basically directed to a novel cap suitable for seatment on a typical aerosol can, especially the type designed as a shaving cream aerosol, which cap permits the removable engagement and retention of the typical blade cartridge razor positioned thereon. The cap is formed by a peripheral sidewall, a closed top and an open bottom, and includes an elongate slot formed in a portion of the peripheral sidewall, and engagement means formed by a pair of spaced apart lugs mounted on the peripheral sidewall of the cap and spaced below the elongate slot, and positioned in cooperative relation therewith such that the elongate slot is designed to retain the blade cartridge portion of the razor therein, while the spaced apart lugs are designed to disengageably retain the handle portion of the razor therein. In the preferred embodiment of the invention, the cap is further designed to include a plurality of vertically oriented slots formed in the peripheral sidewall of the cap, and spaced in circumferential relationship, one with respect to the other about the periphery of the cap, each of the vertically oriented slots adapted to contain and store a blade cartridge of the type typically used in connection with blade cartridge razors.

DETAILED DESCRIPTION OF THE INVENTION

By way of background, the present invention is specifically designed to function in connection with presently available shaving blade cartridges of the type which are commercially available and are constructed to include a pair of blades fixedly secured within a disposable cartridge. The cartridge is, in turn, adapted for removable engagement upon a blade cartridge razor of the type which includes a rail which slidably engages the blade cartridge in order to position the same on the razor prior to usage. The twin blade cartridge system of shaving has become quite commercially acceptable, and a number of manufacturers now make and sell a blade cartridge which is of substantially universal configuration. The present invention relates to a cap for an aerosol container of the type generally formed as a shaving cream aerosol can, and while the invention has specific usage in this connection, it will be appreciated that similar other usages may be made of the present invention outside of the environment of the shaving cream container cap designed to store and carry a plurality of blade cartridges and blade cartridge razors. For example, it is anticipated that the present invention may similarly find usage in the cosmetic area wherein a number of implements are employed in connection with a given cosmetic. Hence, while the following description may relate specifically to a shaving cream aerosol can and a cap designed therefor, it will be appreciated that the invention may be employed beyond such a specific usage.

With specific reference to FIGS. 1–3 of the drawings, the storage and dispenser cap, generally referred by the numeral 10, is generally illustrated. The cap 10 is generally shown to be formed by peripheral sidewall 12 having a closed top end 14 and an open bottom end (not shown). As is generally illustrated in the drawings, the cap 10 is designed to be removably positionable atop a shaving cream aerosol can 90 in the manner customarily known with such types of commercial devices.

Figure 7:
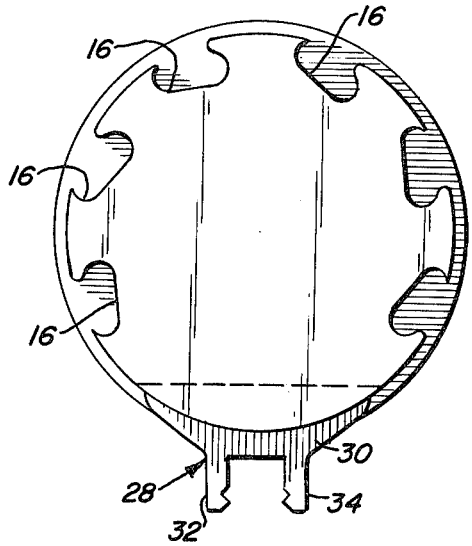
FIG. 7 is a top cross-sectional view showing the details of construction of the retaining means for retaining blade cartridges and the engagement means for retaining the blade cartridge razor taken in the direction of the arrows along the line 7—7 of FIG. 6.
Figure 8:
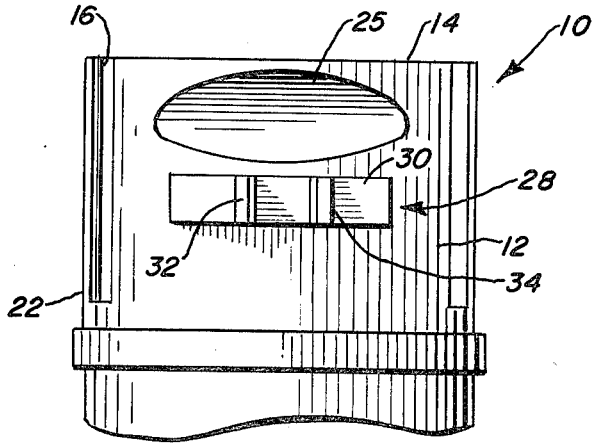
FIG. 8 is a side elevational view, partly cut-away, showing the retention means and engagement means for retaining and engaging in holding relationship of the blade cartridge razor on the subject cap of the present invention.

With specific reference to FIGS. 6 and 7 of the drawings, it will be observed that the peripheral sidewall 12 of the cap 10 includes a series of six vertically oriented slots 16 formed integrally therewith and as a part of the peripheral sidewall 12. As will be observed from the various figures, each of the vertically extending slots 16 assumes the configuration of a typically available blade cartridge 18 of the type presently commercially available. In this connection, a substantially ovoid configuration would be observed, which generally corresponds with the cross-sectional configuration of such twin blade cartridges.

As is further evident from FIGS. 2 and 3 of the drawings, access to the vertically extending slots 16 is had through a cut-away portion 20 formed in the top wall 14 of the cap 10. Again, as is evident from FIGS. 2 and 3 of the drawings, the blade cartridges 18 may be easily withdrawn from the respective vertically extending slots 16 by a simple snap action through the open side portion of slot 16. As is further evident from the drawings, each of the vertically extending slots 16 includes a lower closed end 22 such that the blade cartridge 18 may be slidably positioned within the slot 16 only to the lowermost extant bounded by the lower closed end 22. It will, therefore, be appreciated that the storage and dispenser cap 10 is conveniently provided with a plurality of six vertically extending slots 16 which function as storage chambers for a corresponding blade cartridge 18 such that the cap may carry a series of six of such blade cartridges 18 whether positioned atop the shaving cream can 90 or when removed therefrom. Hence, a convenient and efficient storage container cap is thereby provided.

A further feature of the present invention relates to the retention and engagement means for retaining disengageable engagement a blade cartridge razor of the type generally shown in the drawings and referred to by the numeral 50. The blade cartridge razor includes a rail head portion 52 which slidably nests with the blade cartridge 18 in a manner commonly known. The blade cartridge razor is completed by a handle portion 54 which operates as the grasping portion for the user thereof. As is shown in FIGS. 1–3 and 6–8 of the drawings, the cap is further designed to include an elongate slot 25 formed integrally in the peripheral sidewall 12 along a line parallel to the tangential plane of the peripheral sidewall and generally positioned below the closed top end 14 of the cap 10. Formed integrally with the peripheral sidewall 12 and spaced below the elongated slot 25 is a handle engagement clip generally referred to by the numeral 28 which is formed by a main body portion 30 which is formed integrally with the peripheral sidewall 12. Extending laterally outwardly from the main body portion 30 of the clip 28 are a pair of spaced apart lugs 32 and 34 respectively, which are spaced apart a distance approximately equal to or slightly less than the width dimension of the handle portion 54 of the razor 50.

As is evident from FIGS. 1 and 6 of the drawings, the blade cartridge razor 50 may be conveniently stored and retained on the cap 10 by simply inserting the blade cartridge portion 18 of the razor 50 within the confines of the elongate slot 25 while the spaced apart lugs 32 and 34 respectively function to grasp and retain the handle portion 54 of the razor therebetween.

It will now be appreciated that the storage and dispenser cap of the present invention functions to permit the storage and dispensing of blade cartridges 18 therefrom, while simultaneously functioning to provide a convenient and compact storage compartment for a fully assembled blade cartridge razor 50. It will be appreciated that the storage and dispensing function of the cap 10 eliminates wasting of a great deal of space in a medicine chest or cabinet of the type generally found in the home while at the same time providing convenient and ready access to a razor for shaving purposes. It will also be appreciated that the cap 10, when removed from the shaving cream can 90, eliminates and obviates any problem of the interference of any elements with the nozzle portion of the shaving cream can 90, since the storage portion of the dispensing cap 10 is formed integrally with the peripheral sidewall 12.

It will also be appreciated that since the elongate slots 16 are designed in the same configuration as the corresponding blade cartridges 18, the blades will be positioned toward the inside surface of the slot 16. Hence, the blades of the cartridge 18 are not exposed to the outer periphery of the cap 10. In this manner, the possibility of the user cutting his fingers or hand in handling the cap 10 is eliminated.

It will be appreciated that the device of the present invention may be formed as a cap 10 which eliminates the blade cartridge storage slots 16 and simply provides the elongate slot 25 and handle engagement clip 28 to simply store the blade cartridge razor 50. However, it is deemed that in the preferred embodiment, since the cap 10 is generally formed as an injection molded part, that the part may be injection molded to include the vertically extending slots 16 thereby to similarly provide storage compartments for a plurality of blade cartridges 18.

As was disclosed in my previously pending application, Ser. No. 653,967 and entitled BLADE CARTRIDGE DISPENSER, now abandoned, an alternate form of a blade cartridge storage and dispenser chamber 60 is illustrated in FIGS. 4 and 5 of the drawings. In this embodiment, the chamber 60 is formed as a separate element and is not intended as a storage and dispenser cap 10 of the type which may be removably positioned atop a shaving cream can 90. However, as is commonly known, the blade cartridges 18 are usually provided in a flat pack containing anywhere from four to ten of the blade cartridges 18 and it is therefore often difficult to store in a medicine chest. The blade cartridge storage and dispenser chamber 60 is designed as an elongated chamber, generally referred to by the numeral 62 (FIG. 5), which is separated by median wall 63 to provide a pair of adjoining chambers as shown in FIG. 5 of the drawings. In the preferred embodiment of this form of the invention, each of the adjoining chambers 62 is adapted to contain a plurality of three blade cartridges 18 in each chamber, thereby accommodating a total of six blade cartridges 18 within the entire blade cartridge storage and dispenser chamber 60. The dispensing characteristics of the chamber 60 are provided by means of a pusher 64 which includes a thumb grip portion 65 which is formed intergrally with a boss 66 connected to the thumb grip portion 65 by means of a neck element 67. The neck element rides in a vertically elongate grove 69 such that the boss 66 rides within the chamber 62 while the thumb grip portion 65 remains external to the chamber 62. A leaf spring element 71 is provided mounted to the thumb grip portion 65 and similarly carried within the groove 69 such that the boss 66 and leaf spring element 71 coact to prevent the slidable dispensing of a blade cartridge 18 from within the chamber 62. The entire assembly is enclosed by means of a cap 73 which encloses the pair of elongate chambers 62 thereby to keep the blade cartridges 18 contained within the chamber 60 in a clean and substantially sterile condition when in non-use.

While it is deemed desirable to provide a storage and dispensing chamber 60 of the type depicted in FIGS. 4 and 5 of the drawings, the preferred embodiment of the invention provides an entire storage and dispenser cap 10 of the type illustrated in FIGS. 1-3 and 6-8 of the drawings. Hence, it is deemed to be preferable to provide a device which will accommodate and storage not only the blade cartridges 18 but also a blade cartridge razor 50 as heretofore described in connection with the abovementioned figures.

In terms of manufacture, it will be appreciated that the storage and dispenser cap 10 as depicted and described in connection with the preferred embodiment of the invention may be formed as an integral unit, especially by means of any molding operation which will permit the integral molding of the cap 10 formed by the peripheral sidewall 12 and the closed top end 14. In addition, the mold may be formed to form the vertically elongated slots 16 as well as the handle engagement clip 28 during the molding operation. In addition, it will be appreciated that most of the commercially available aerosol cans are provided with plastic container caps, and hence, it is deemed to be the preferred mode of manufacture to form as an integrally molded unit a storage and dispenser cap 10 of the type described hereinabove incorporating the features as set forth herein.

It will now be appreciated that the present invention provides an improved storage and dispensing cap which is designed to be removably positionable upon any type of aerosol or other type of can wherein it is desired to store and permit the easy dispensing of articles stored within the storage chambers provided in the cap. In connection with the previous description, it will be appreciated from FIGS. 2 and 3 of the drawings that the mode of dispensing the blade cartridges 18 from the cap 10 is simplified since the blade cartridge razor 50 is provided with a rail head portion 52. In order to remove a blade cartridge 18 from one of the vertically elongated slots 16, the rail head portion 52 of the blade cartridge razor 50 may simply be slidably engaged into the rails provided in the blade cartridge 18 and manual pressure applied in an inward direction to unsnap the blade cartridge 18 from the slot 16. As the entire blade cartridge razor 50 is then removed, the blade cartridge 18 will be disengaged from the corresponding vertically extending slot 16 by a snap action similar to the manner of removal from existing flat packages presently commercially available. It is for this reason that the preferred embodiment of the invention contemplates a cap 10 formed to accommodate a plurality of vertically extending slots 16 which function as storage chambers for blade cartridges 18 as well as to provide a handle engagement clip 28 which coacts with the elongate slot 25 to provide a blade cartridge razor 50 storage and retention assembly.

It will be appreciated that by virtue of the present invention, there has been provided a convenient and economically efficient cap adapted for use in connection with any type of aerosol or other container wherein a plurality of implements are needed to perform any given cosmetic or other type of function. Hence, while the present invention has specific reference to a shaving cream can, it will be appreciated that any number of cosmetic, medicinal, or other types of containers may similarly be provided with a cap of the type described herein. It is therefore appreciated that all of the above objects and advantages have been accomplished by means of the storage and dispenser cap depicted herein and the various embodiments thereof to provide an extremely compact storage and dispensing device which may be formed on a mass production basis and within the economic necessities of the commercial marketplace.

While there has been described what is at present considered to be the preferred embodiments of the invention, it will be understood that various modifications may be made therein and it is intended to cover the appended claims all such modifications as fall within the true spirit and scope of the invention.

What is claimed is:

1. A cap for enclosing a shaving cream can constructed to accommodate a plurality of blade cartridges and a blade cartridge razor, comprising in combination, a cap adapted for removable positioning atop the shaving cream can, said cap being formed by a peripheral side wall and having a closed top and an open bottom, said cap including at least one holding means formed integrally therewith for removably holding a blade cartridge therein, said holding means being formed by a vertically extending lock slot formed in said peripheral side wall, said slot having a closed bottom and open top, said open top formed as a cut-away portion in said top of said cap such that a blade cartridge may be vertically positioned within said slot through said cut-away open top end thereof, and said blade cartridge may be removably positioned within said vertically extending slot, said peripheral side wall of said cap being further provided with retention means formed integrally therewith for retaining a blade cartridge razor in disengageable engagement therein, and said cap including said holding means and said retention means being entirely removable from the shaving cream can while simultaneously adapted to hold said blade cartridge and retain said blade cartridge razor when in a removed position.

2. The cap as set forth in claim 1 above, which further includes a plurality of said holding means formed integrally therewith to accommodate a plurality of the blade cartridges, one of the blade cartridges positioned in each of said holding means.

3. The cap as set forth in claim 1 above, wherein said vertically extending slot is formed in the configuration of the blade cartridge, and having an overall interior dimension slightly in excess of the exterior dimension of the blade cartridge, whereby the blade cartridge is removably positionable within said vertically extending slot.

4. The cap as set forth in claim 1 above, wherein said retention means comprises as elongate slot formed in said peripheral side wall and extending along a line parallel to the tangential plane of said peripheral side wall and said peripheral side wall further including cooperating engagement means positioned in cooperative relation with said elongate slot to facilitate the retention and removable engagement of a blade cartridge razor on said cap, whereby the blade cartridge carried by the blade cartridge razor is positionable within said elongate slot and the handle portion of the blade cartridge razor is removably positionable in said cooperating engagement means.

5. The cap as set forth in claim 4 above, wherein said cooperating engagement means comprises a pair of spaced apart lugs mounted on said peripheral side wall and extending laterally outwardly therefrom, said pair of lugs being positioned below said elongate slot and in cooperative relation therewith, whereby the blade cartridge carried by the blade cartridge razor is positionable in said elongate slot, and the handle portion of the blade cartridge razor is removably positionable within and between said pair of spaced apart lugs.

6. A cap for enclosing a shaving cream can constructed to accommodate a plurality of blade cartridges and a blade cartridge razor, comprising in combination, a cap adapted for removable positioning atop the shaving cream can, said cap being formed by a peripheral side wall and having a closed top and an open bottom, said peripheral side wall and top being substantially cylindrical in configuration, said cap further provided with a plurality of vertically oriented holding means formed therein, each of said holding means adapted to accommodate a blade cartridge therein, each of said holding means being formed by a vertically extending slot formed in said peripheral side wall, said slot having a closed bottom and an open top, said open top formed as a cut-away portion in the top of said cap whereby a blade cartridge may be vertically positioned within said slot through said cut-away open top end thereof, such that each of said blade cartridges may be removably positioned within said vertically extending slot, said peripheral side wall further including an elongate slot extending along a line parallel to the tangential plane of said peripheral side wall, engagement means mounted on said peripheral side wall of said cap and positioned below said elongate slot, said engagement means cooperating with said elongate slot to facilitate the retention of the blade cartridge razor therein, and said cap including said vertically oriented holding means and said elongate slot and said engagement means being formed as an integral unit.

7. The cap as set forth in claim 6 above, wherein each of said holding means comprises a vertically extending slot formed in said peripheral side wall, said slot having a closed bottom and an open top, said open top formed as a cut-away portion in said top of said cap, whereby a blade cartridge may be accommodated and retained within the confines of said vertically extending slot and being removeable therefrom through the cut-away top portion formed in the top of said cap.

8. The cap as set forth in claim 7 above, wherein each of said vertically extending slots is formed in the configuration of the blade cartridge and having an overall interior dimension slightly in excess of the exterior dimension of the blade cartridge, whereby the blade cartridge may be removably positioned within the confines of said vertically extending slot thereby to be removable therefrom through the cut-away portion in the top of said can.

9. The cap as set forth in claim 8 above, wherein said engagement means comprises a pair of spaced apart lugs mounted on said peripheral side wall and extending laterally outwardly therefrom, said pair of lugs being positioned below said elongate slot and in cooperative relation therewith whereby the blade cartridge portion of the blade cartridge razor may be accommodated within the confines of said elongate slot and the handle portion of the blade cartridge razor may be removably positioned within the confines of said spaced apart lugs thereby to be removably engageable therefrom.

10. The cap as set forth in claim 9 above, wherein said plurality of vertically extending slots are circumferentially positioned around the cylindrical periphery of said cap.

* * * * *